US008425391B2

(12) United States Patent
Branger

(10) Patent No.: US 8,425,391 B2
(45) Date of Patent: Apr. 23, 2013

(54) PACKAGE WITH FOLDABLE PACKAGE HANGER AND ASSEMBLY METHOD

(75) Inventor: Robert Michael Branger, San Diego, CA (US)

(73) Assignee: Robert Michael Branger, San Diego, CA (US)

( * ) Notice: Subject to any disclaimer, the term of this patent is extended or adjusted under 35 U.S.C. 154(b) by 93 days.

(21) Appl. No.: 12/198,773

(22) Filed: Aug. 26, 2008

(65) Prior Publication Data

US 2010/0089933 A1 Apr. 15, 2010

(51) Int. Cl.

| | |
|---|---|
| ***B31B 1/26*** | (2006.01) |
| *B65D 25/00* | (2006.01) |
| *B65D 85/18* | (2006.01) |
| *A41D 27/22* | (2006.01) |

(52) U.S. Cl.

USPC ..... 493/405; 220/751; 223/87; 206/288

(58) Field of Classification Search ..... 220/751, 220/62, 756, 752, 482, 481, 480, 694; 229/117.18, 229/117.12, 117.09; 493/405, 395; D9/722, D9/715, 415, 414, 433; 223/DIG. 3, 94, 223/89, 88, 87, 85; 206/279, 299, 288, 289, 206/287.1, 287, 396, 395, 806; *B65D 25/00, B65D 85/18; B31B 1/26; A41D 27/22*

See application file for complete search history.

(56) References Cited

U.S. PATENT DOCUMENTS

| | | | | | |
|---|---|---|---|---|---|
| 1,330,033 | A | * | 2/1920 | Alland | 229/402 |
| 1,731,966 | A | * | 10/1929 | Anderson | 361/60 |
| 1,731,996 | A | * | 10/1929 | Appelbaum | 206/288 |
| 1,760,352 | A | * | 5/1930 | Feigelman | 223/87 |
| 2,169,552 | A | * | 8/1939 | Bellin | 223/68 |
| 2,349,200 | A | * | 5/1944 | Ringler | 223/87 |
| 2,386,603 | A | * | 10/1945 | Glaser | 223/87 |
| 2,555,719 | A | * | 6/1951 | Vineberg | 206/288 |
| 2,608,292 | A | * | 8/1952 | Stensgaard | 206/288 |
| 2,910,214 | A | * | 10/1959 | Gouner | 223/87 |
| 3,056,528 | A | * | 10/1962 | Shiels, Jr. | 206/183 |
| 3,205,614 | A | * | 9/1965 | Brosk | 446/73 |
| 3,246,812 | A | * | 4/1966 | Walker et al. | 223/87 |
| 3,370,765 | A | * | 2/1968 | Jossem | 223/87 |
| 3,534,864 | A | * | 10/1970 | Larson | 248/222.51 |
| 3,650,442 | A | * | 3/1972 | Berns et al. | 223/87 |
| 3,659,704 | A | * | 5/1972 | Collura et al. | 206/288 |
| 3,841,478 | A | * | 10/1974 | Wells et al. | 206/495 |
| 3,862,687 | A | * | 1/1975 | Pirman | 206/527 |
| 3,881,649 | A | * | 5/1975 | Krautsack | 229/117.12 |
| 3,899,078 | A | * | 8/1975 | Ambrozetes et al. | 206/335 |
| 3,907,104 | A | * | 9/1975 | Taub | 206/45.23 |
| 4,132,309 | A | * | 1/1979 | Shaylor | 206/278 |
| 4,190,151 | A | * | 2/1980 | Russell | 206/281 |
| D264,185 | S | * | 5/1982 | Roberts | D9/433 |
| 5,020,660 | A | * | 6/1991 | Akerley et al. | 206/411 |
| 5,452,802 | A | * | 9/1995 | Green | 206/466 |

* cited by examiner

*Primary Examiner* — Mickey Yu
*Assistant Examiner* — Robert J Hicks

(57) ABSTRACT

A foldable package made from one sheet of material where the top portion folds into 3 or more layers. Cutouts in each of the layers line up in a way to make a J-shaped hook. The 3 or more layers fold longitudinally to form a flat tab with a J-shaped hook. The J-shaped hook is then used as a supportive apparatus which allows easy removal of items from a peg.

1 Claim, 5 Drawing Sheets

PACKAGE WITH FOLDABLE PACKAGE HANGER AND ASSEMBLY METHOD

BACKGROUND OF THE INVENTION

Many retail packages have been constructed from flat sheets of paper or plastic or other material in the past. The flat sheets are die-cut and folded in a manner that makes the finished package. Various methods have been incorporated to allow these packages to be displayed and hung on retail displays. Most common is simply a hole drilled in the top flap of the package for a peg to extend through.

It is often desirable to have a J shaped type hook, or L-shape hook, as the package doesn't have to be slipped all the way off the peg to be removed. This is especially valuable when there are multiple SKU's on one peg and one of the back items needs to be removed from the peg. The J-shaped hook allows the item to simply be moved to the side and removed from the peg without removing all the items in front of it on the same peg.

Many methods have been used to incorporate J-shaped hooks onto packages. Adding additional material to the package in the shape of a J by gluing, welding, riveting or other means are used to attach the hook to the package; see FIG. 1.

In the past a J has been cut in the top of the unfolded package so when folded, the J is on the top of the package as shown in FIG. 2. This method won't work with package materials that are not strong enough to hold the package and the weight of its contents. The J will deform or bend allowing the package to fall off the hook. This is especially true for paper packaging or thin plastic packaging.

A slightly improved method is where 2 layers are folded and each layer lines up to make a J as shown by 2 examples in FIG. 3. This method won't work with package materials that are not strong enough to hold the package and the weight of its contents. The J will deform or bend under weight allowing the package to fall off the hook.

Another common problem with hangers is the amount of shelf space they require. Ideally, a low profile hanger is used on packaging allowing more packages to be hung in the same location.

The current invention solves above mentioned problems.

BRIEF SUMMARY OF THE INVENTION

The current invention describes a method and resulting J-shaped hook hanger for a foldable package. It can be designed for different weights allowing heavier items to be in the package and is easily incorporated in the foldable box design by making the package and hanger from the same piece of flat material. The hanger can be made with a low profile requiring less shelf space.

DETAILED DESCRIPTION OF THE INVENTION

Figure 1:
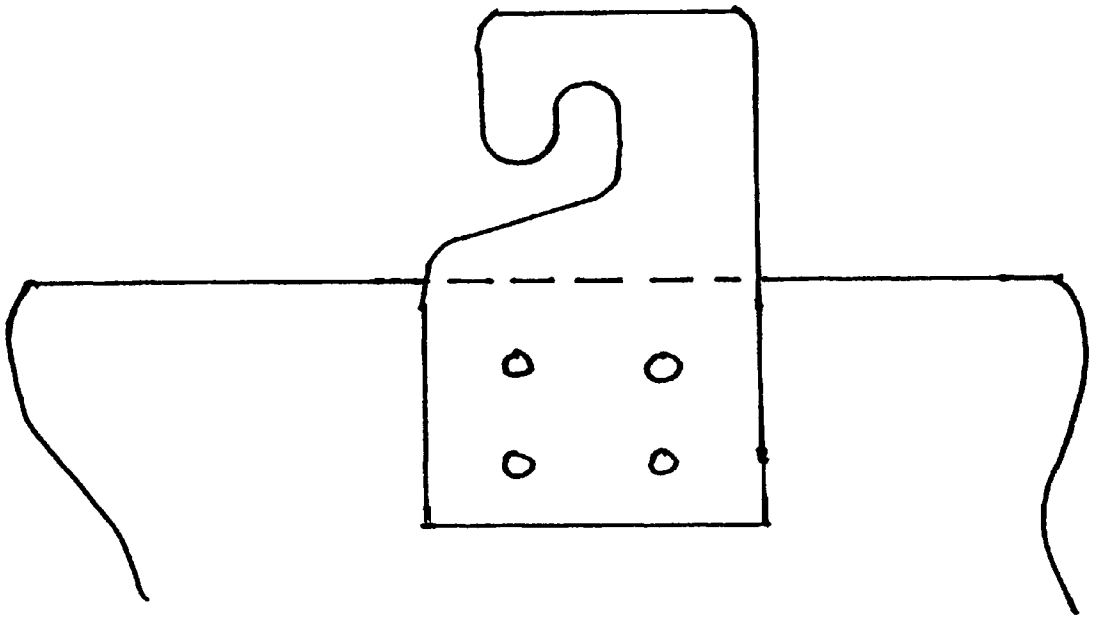
Figure 1 Prior Art
FIG. 1—Prior Art: J-shaped hook welded or riveted onto the top of a package.
Figure 2:
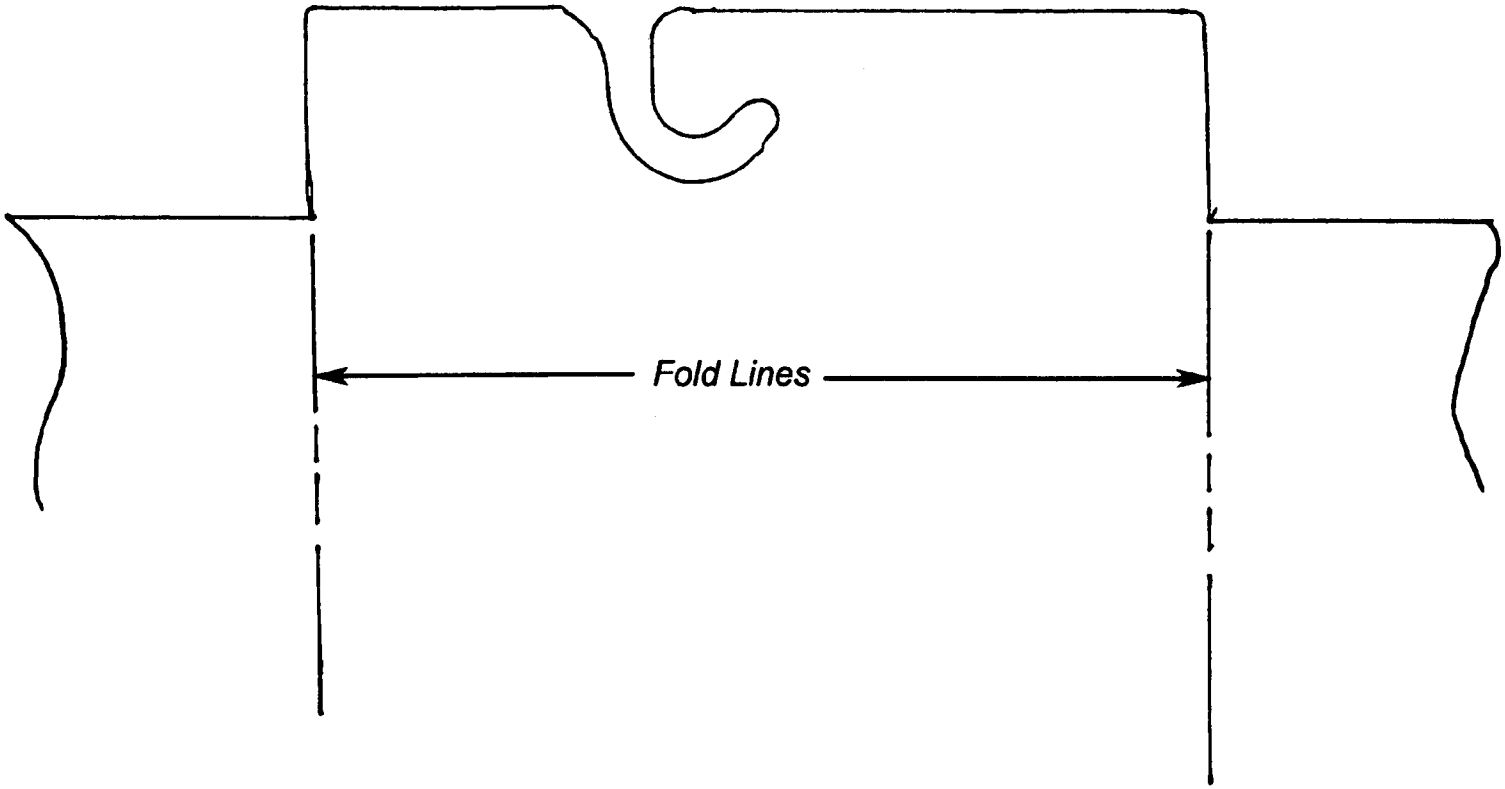
Figure 2 Prior Art
FIG. 2—Prior Art: Simplest J-shaped hook design on foldable package. Package and hook are all made from same flat piece of material.
Figure 3:
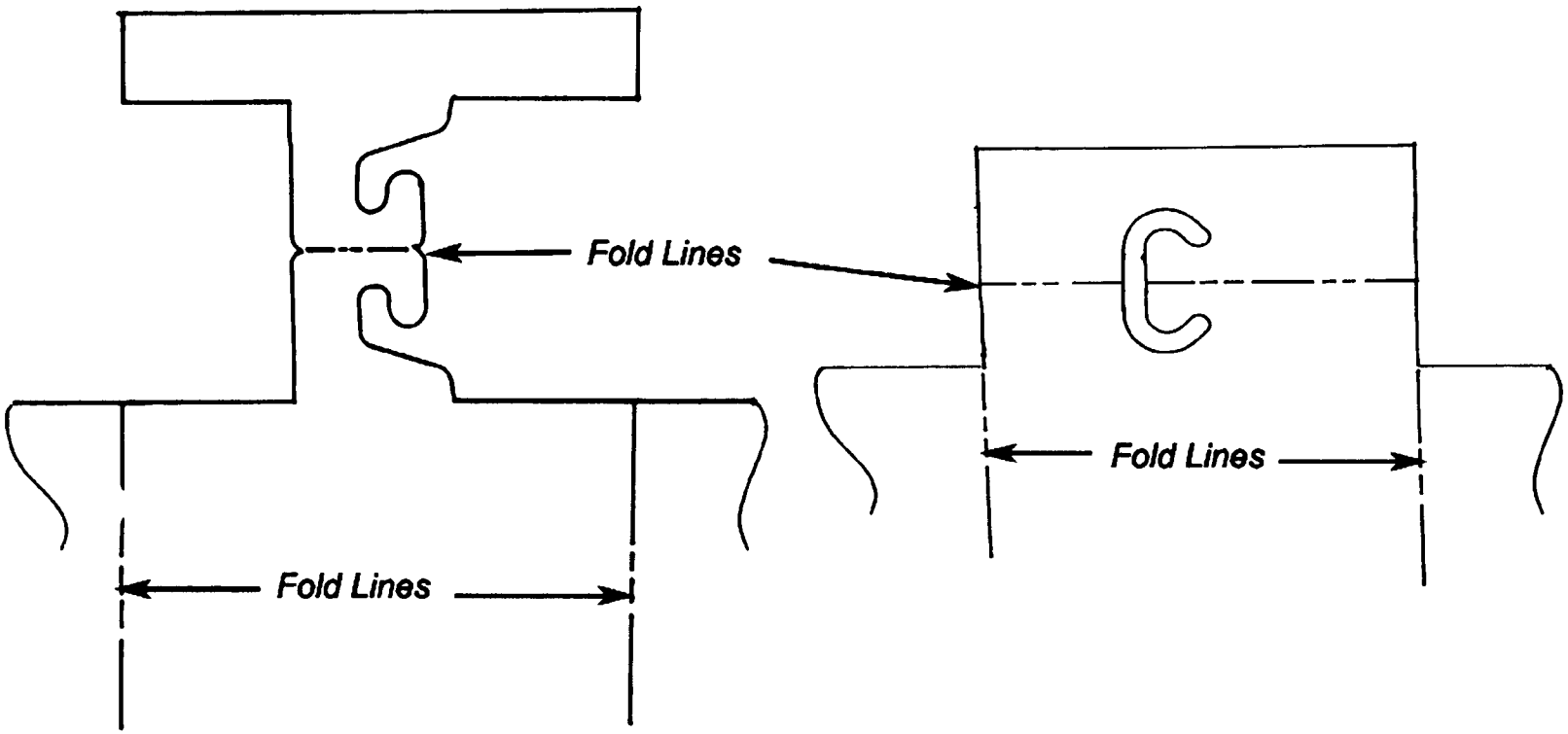
Figure 3 Prior Art
FIG. 3—Prior Art: Examples of 2 layer J-shaped hooks used on foldable packages. Package and hooks are all made from same flat piece of material.
Figure 4:
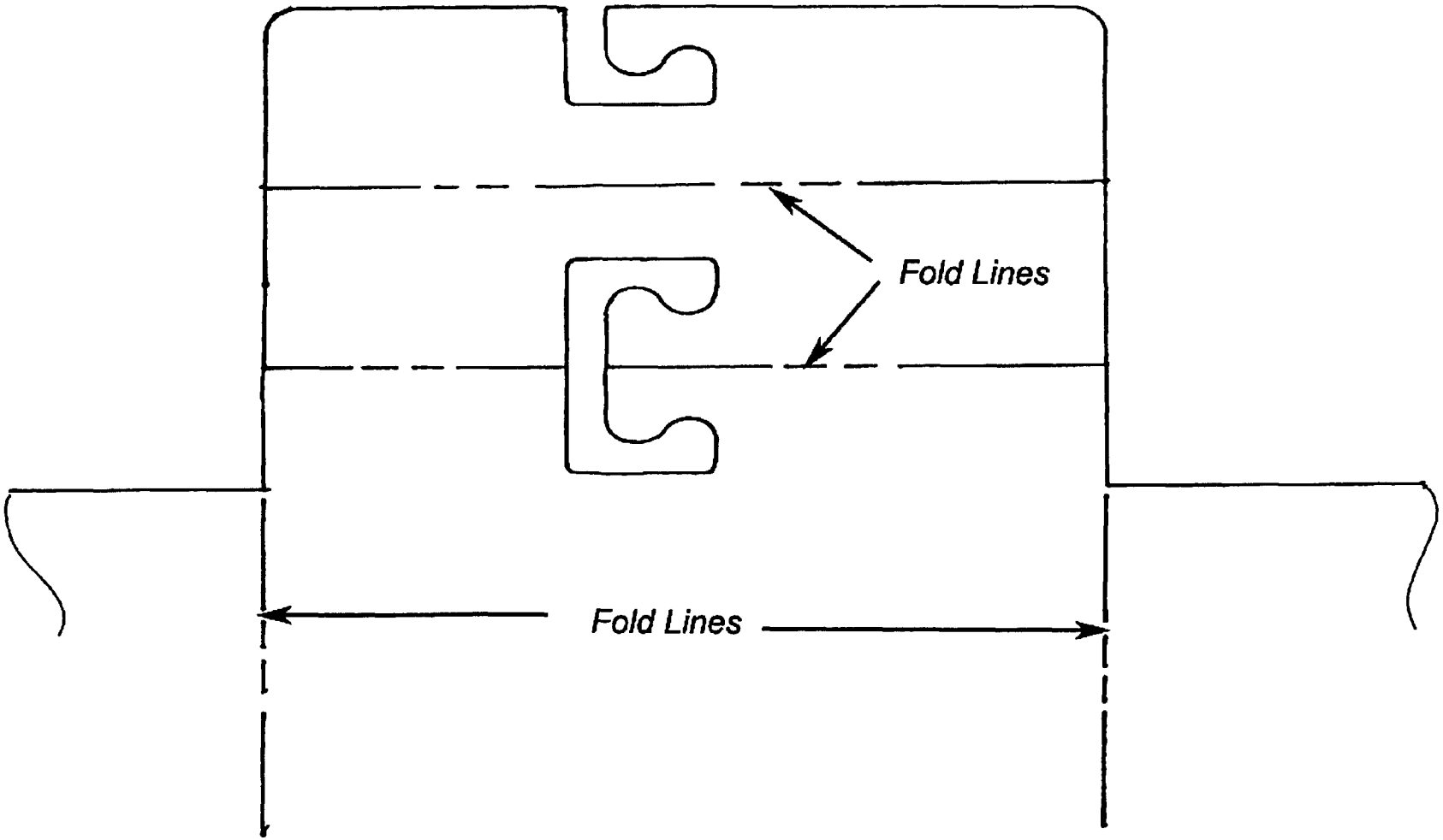
FIG. 4—Current invention: 3 layers folding together from the same piece of flat material to make the package much stronger.
Figure 5:
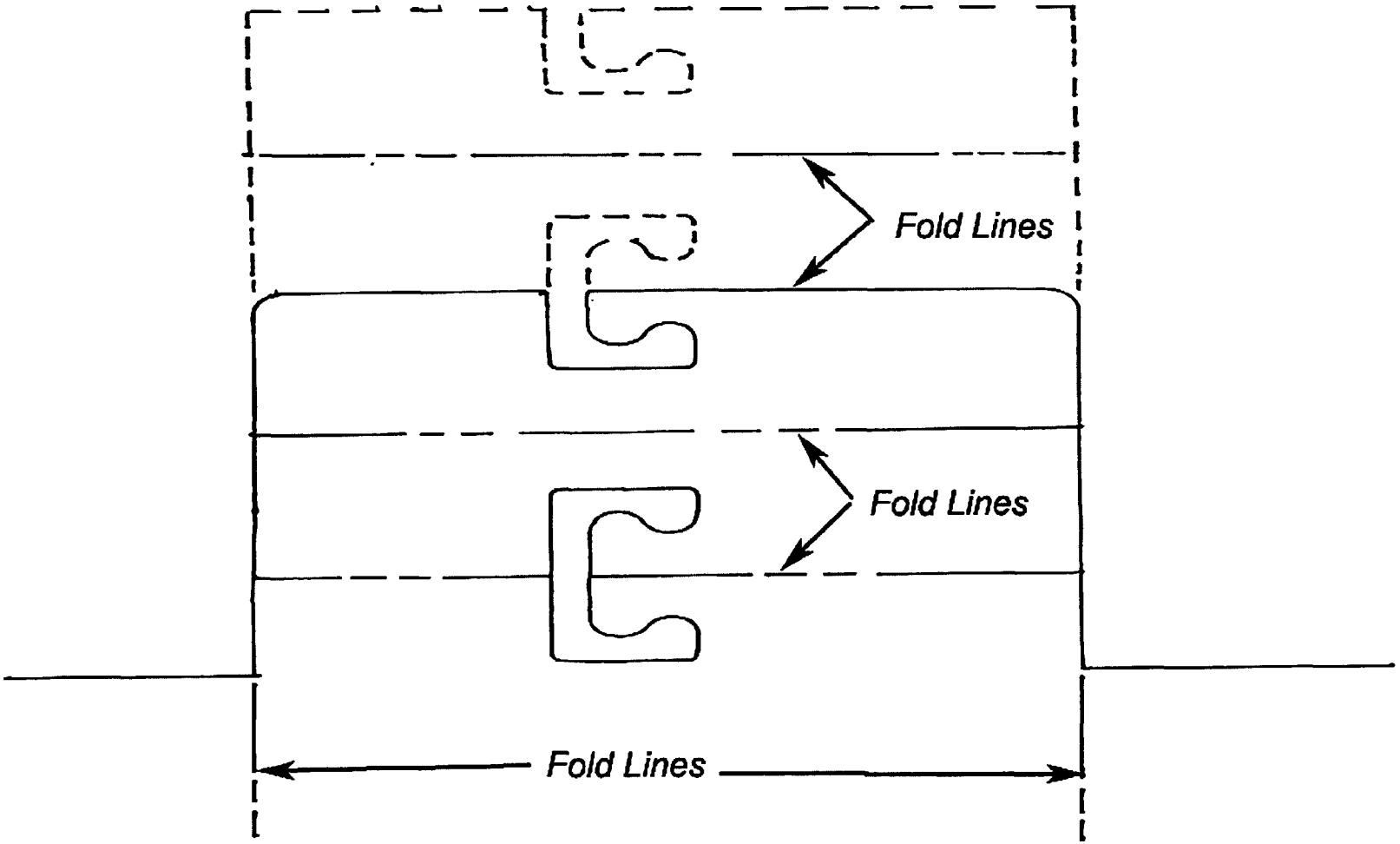
FIG. 5—Current invention: 3 (or more) layers folding together from the same piece of flat material to make the package as strong as desired. Solid J-shaped hook lines represent the three primary layers. The dashed J-shaped hooks illustrate additional folds that could be incorporated to strengthen the design beyond the first 3 layers.

The current invention describes a method and resulting J-shaped hook hanger for a foldable package. It can be designed for different weights allowing heavier items to be in the package and is easily incorporated in the foldable box design by making the package and hanger from the same piece of flat material. If additional strength is needed, additional layers could be added and folded on to themselves to reinforce the J-shaped hook.

The hanger can be made with a low profile requiring less shelf space. The top flap only needs to be slightly larger than the diameter of the hanging peg. In the current invention a top flap of 20 mm is more than adequate for a 7 mm diameter peg.

The invention claimed is:

1. A method for constructing a J-shaped hook hanger on a foldable package, said method consisting of: a single flat piece of material with horizontal fold lines which is folded to make a package and hanger, and wherein at least two of said cutouts form a horse shoe or U-shaped design, a top of said package is folded in three or more layers, wherein each of said layers has a J-shaped cutout forming said hanger, and after folding perpendicular to an item which creates a weight bearing force, all said cutouts line up resulting in a composite tab to improve strength characteristics with an opening to accommodate a peg for hanging said package.

* * * * *